United States Patent [19]

Crossley et al.

[11] Patent Number: 4,864,104

[45] Date of Patent: Sep. 5, 1989

[54] HEATING ASSEMBLY USING TUNGSTEN-HALOGEN LAMPS

[75] Inventors: Peter W. Crossley, Hampshire; Bernard F. Fellerman, Hayling Island; Graham H. Goodchild, Hampshire, all of England

[73] Assignee: Thorn Emi Patents Limited, Hayes, England

[21] Appl. No.: 143,063

[22] Filed: Jan. 12, 1988

Related U.S. Application Data

[63] Continuation of Ser. No. 49,049, May 11, 1987, Pat. No. 4,751,370, which is a continuation-in-part of Ser. No. 563,930, Dec. 21, 1983, abandoned.

[30] Foreign Application Priority Data

| | | | |
|---|---|---|---|
| Dec. 24, 1982 | [GB] | United Kingdom | 8236797 |
| Mar. 24, 1983 | [GB] | United Kingdom | 8308105 |
| Aug. 1, 1983 | [GB] | United Kingdom | 8320717 |

[51] Int. Cl.[4] ..... H05B 3/74

[52] U.S. Cl. ..... 219/464; 219/460; 219/461

[58] Field of Search ..... 219/464, 458, 459, 460, 219/461, 465, 466, 448, 449, 354

[56] References Cited

U.S. PATENT DOCUMENTS

| | | | |
|---|---|---|---|
| 2,601,011 | 6/1952 | Wilcox | 219/461 |
| 2,883,571 | 4/1959 | Fridrich | 313/315 |
| 3,086,101 | 4/1963 | Scofield . | |
| 3,355,574 | 11/1967 | Bassett | 219/464 |
| 3,448,320 | 6/1969 | Millikan | 313/315 |
| 3,579,021 | 5/1971 | Kimball | 313/274 |
| 3,602,761 | 8/1971 | Kimball | 313/315 |
| 3,612,828 | 10/1971 | Siegla | 219/464 |
| 3,663,798 | 5/1972 | Speidel | 219/464 |
| 4,221,672 | 9/1980 | McWilliams | 252/62 |
| 4,296,311 | 10/1981 | Hagglund | 219/464 |
| 4,357,523 | 11/1982 | Bleckmann | 219/464 |
| 4,388,520 | 6/1983 | McWilliams | 219/464 |
| 4,414,465 | 11/1983 | Newton | 219/449 |

FOREIGN PATENT DOCUMENTS

| | | |
|---|---|---|
| 2164162 | 6/1973 | Fed. Rep. of Germany . |
| 263254 | 12/1926 | United Kingdom . |
| 241554 | 1/1927 | United Kingdom . |
| 398093 | 9/1933 | United Kingdom . |
| 443494 | 2/1936 | United Kingdom . |
| 735000 | 8/1955 | United Kingdom . |
| 908793 | 10/1962 | United Kingdom . |

*Primary Examiner*—Teresa J. Walberg

*Attorney, Agent, or Firm*—Fleit, Jacobson, Cohn, Price, Holman & Stern

[57] ABSTRACT

A heating assembly including at least one infra-red emissive tungsten halogen lamp supported beneath a glass ceramic cooktop which allows useful quantities of the infra-red radiation, as emitted by the lamp (or lamps) and directly incident on the undersurface of the cooktop, to emerge from the assembly and above non-metallic, thermally insulating material contained as a layer in the base of a shallow tray. The layer contains, or supports at its surface, material which efficiently reflects the infra-red radiation emitted from the lamp (or lamps) substantially unchanged in spectral content so that useful quantities of the radiation so reflected and then incident on the undersurface of the cooktop emerge from the assembly to supplement the directly incident radiation.

7 Claims, 5 Drawing Sheets

Figure 1:
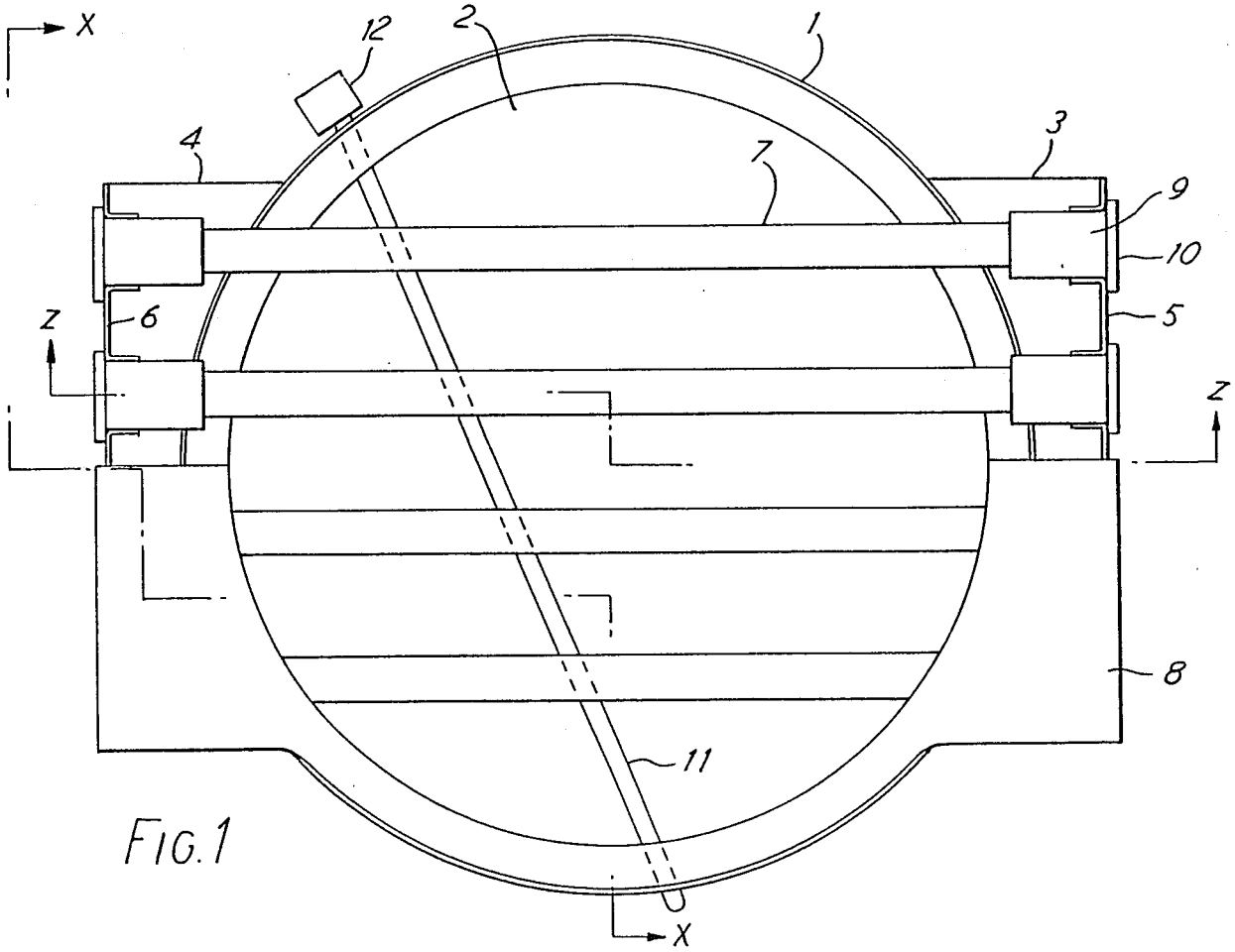

| POWER OUTPUT | CONTROL SETTING | PERCENTAGE OF TOTAL POWER OUTPUT |
|---|---|---|
| 2000W | 6 | 100% |
| 1333W | 5 | 67% |
| 666W | 4 | 33% |
| 442W | 3 | 22% |
| 221W | 2 | 11% |
| 147W | 1 | 7% |
| 0W | 0 | 0% |

HEATING ASSEMBLY USING TUNGSTEN-HALOGEN LAMPS

This is a continuation of application Ser. No. 049,049, filed May 11, 1987, now U.S. Pat. No. 4,751,370 which is a Rule 62 continuation in part of U.S. Ser. No. 563,930, filed Dec. 21, 1983, now abandoned.

This invention relates to heating apparatus and in particular, though not exclusively to such apparatus including one or more sources of infra red radiation of a wavelength within the band 0.8–5 μm, having a peak at approximately 1.2 μm.

Heating apparatus incorporating sources of infra-red radiation is disclosed in U.K. Pat. No. 1273023, to The Electricity Council, wherein one or more sources, each comprising a tungsten filament lamp, are arranged below a glass ceramic cooking hob. A metallic reflector is disposed below the sources so as to reflect radiation, emitted in a downward direction from the sources, upwardly onto and through the underside of the glass ceramic hob. The metallic reflector is preferably made of high purity aluminum which is polished and anodised, and shaped so as to reflect radiation onto the underside of the hob in that area which would be covered by the base of a utensil standing thereon.

However, it has been found that such an arrangement, incorporating a metallic reflector, raises a number of problems, namely that, by placing the reflector close to the infra-red radiation sources to obtain the optimum effect thereof and to produce a relatively shallow arrangement, the reflector may be caused to melt or, at the least, to be greatly distorted and discoloured by the considerable heat emitted from the sources, unless it is not provided with heat insulation, in which case a substantial amount of heat can be lost. This problem may only be alleviated by placing the reflector at a substantial distance from the sources and by not using any heat insulation, thereby reducing the effect of the reflector to an unacceptable level.

It is an object of the present invention to alleviate the above-identified problems by providing a more efficient heating apparatus than that disclosed heretofore, having a relatively rapid response time, which is at least comparable with that of gas-fuelled heating apparatus, whilst retaining the inherent advantage of cleanliness.

According to the present invention, there is provided heating apparatus comprising at least one source of infra-red radiation arranged beneath a support means for supporting a utensil containing food to be heated by said at least one source, a layer of thermally insulative material disposed beneath said at least one source, and means for reflecting infra-red radiation emitted from said at least one source, said means being disposed between said at least one source of infra-red radiation and a major part of the body of said layer of thermally insulative material.

Figure 2:
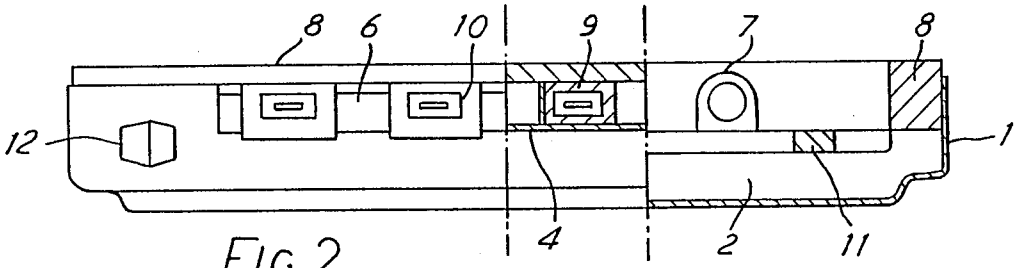
Figure 3:
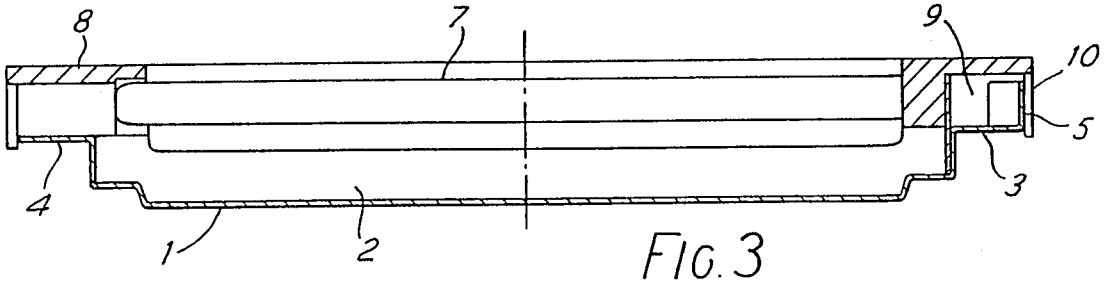
Figure 4:
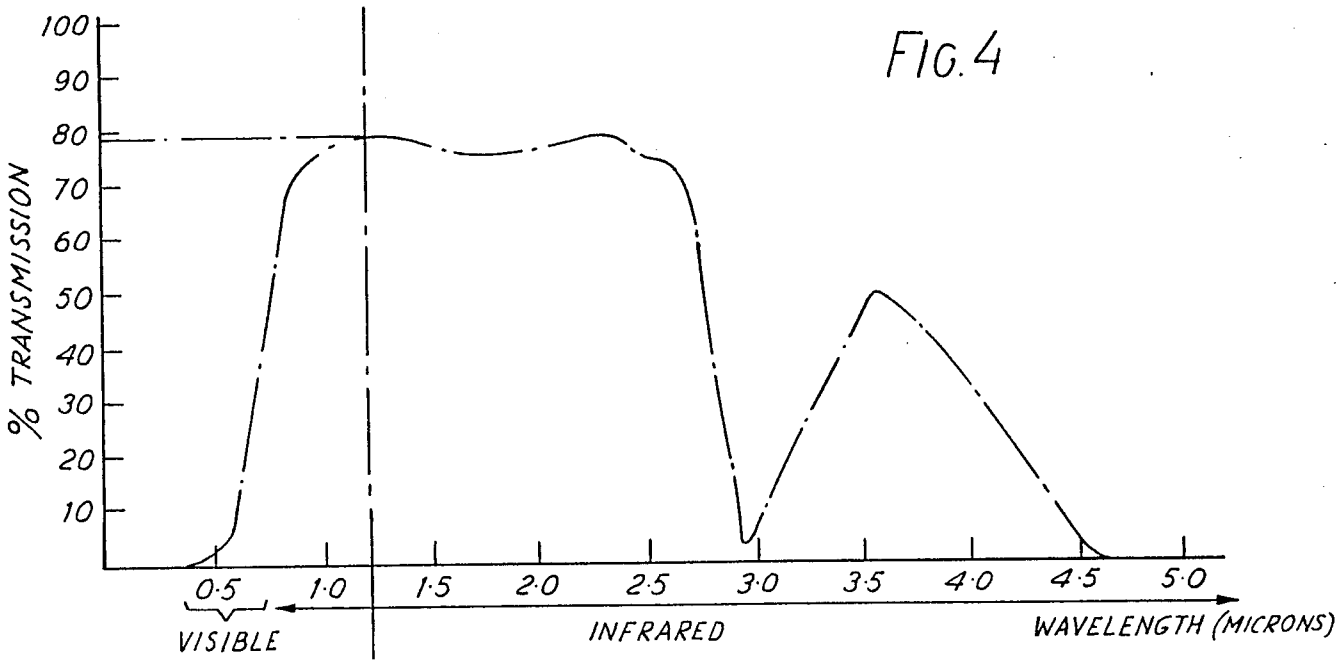
Figure 5:
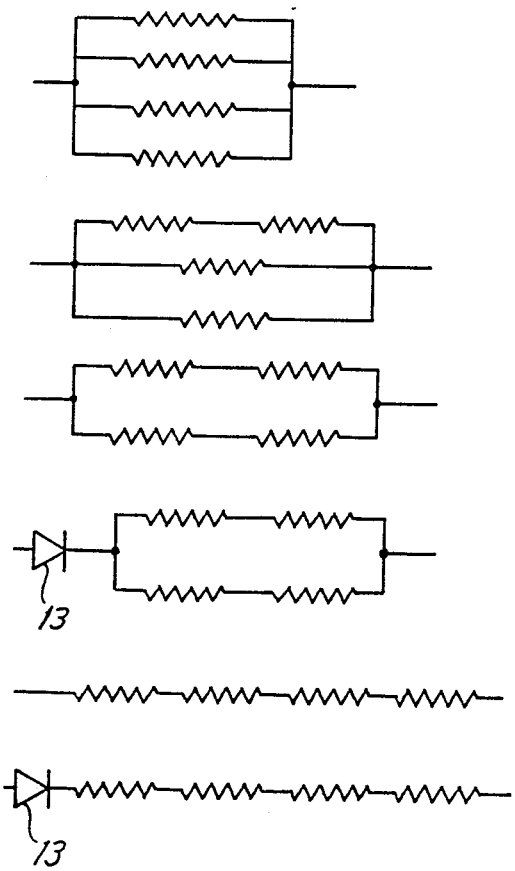
Figure 6:
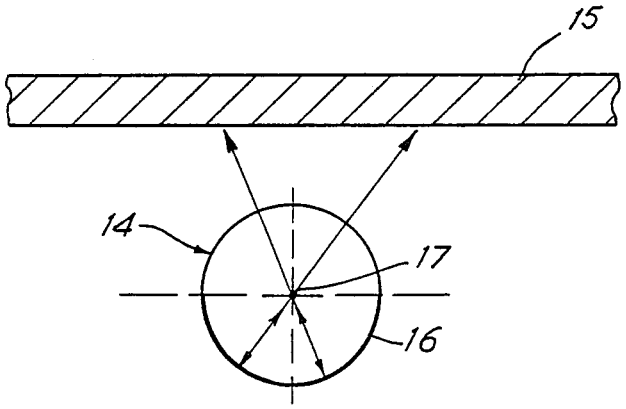
Figure 1:
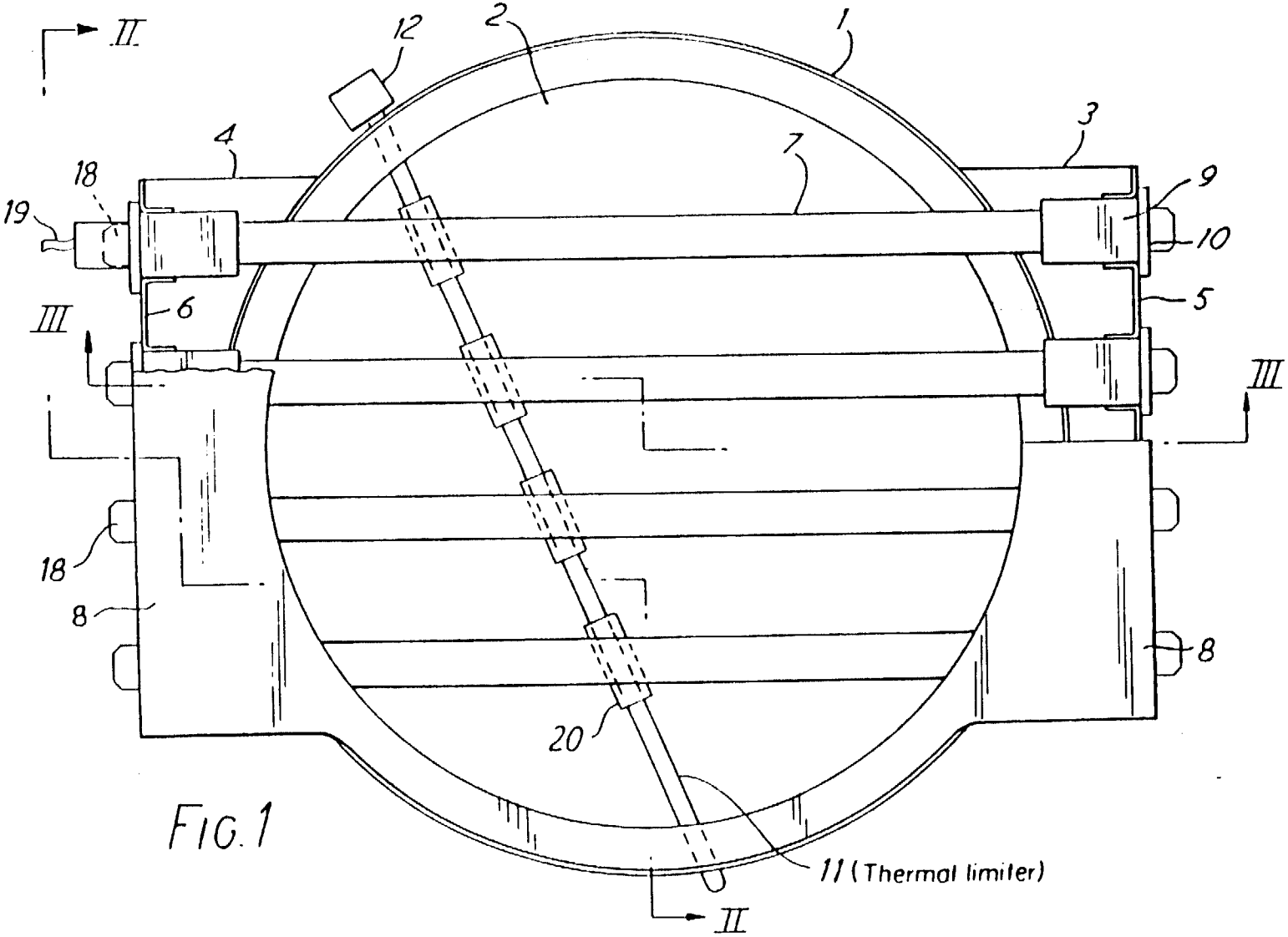
Figure 2:
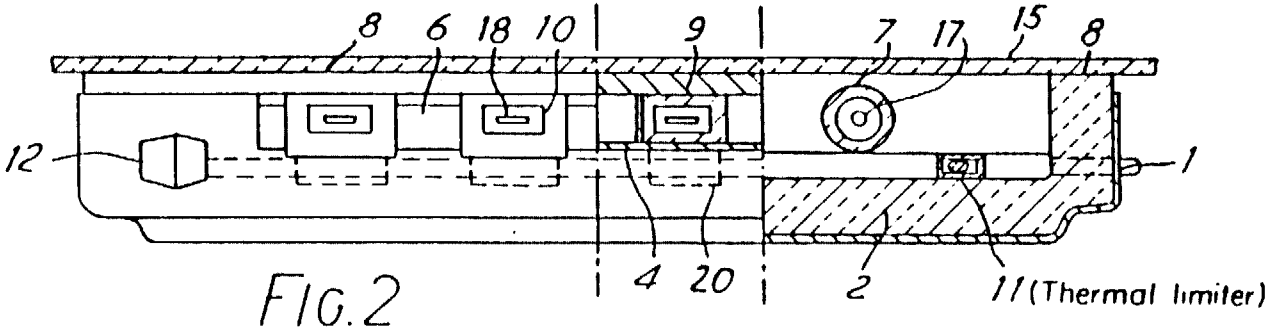
Figure 3:
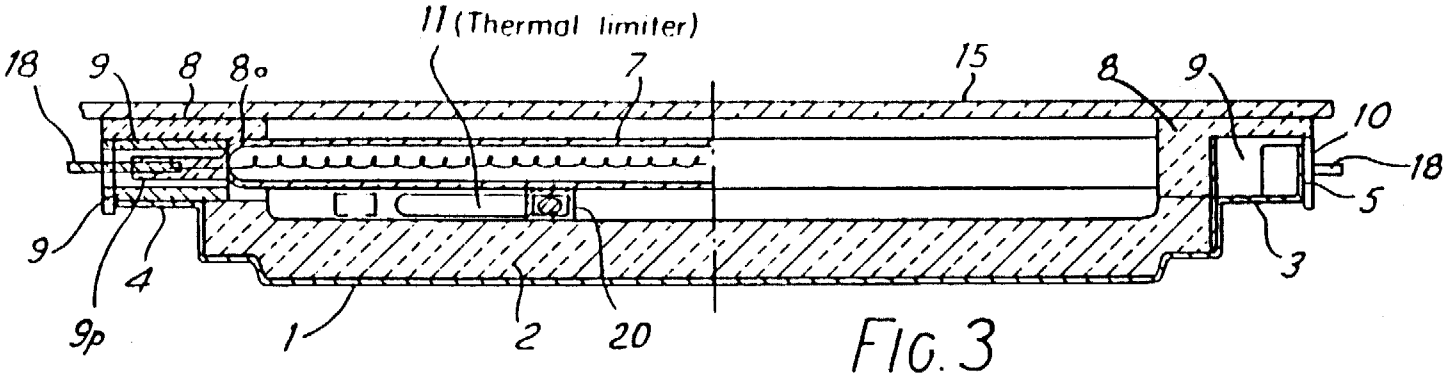
Figures 4, 6:
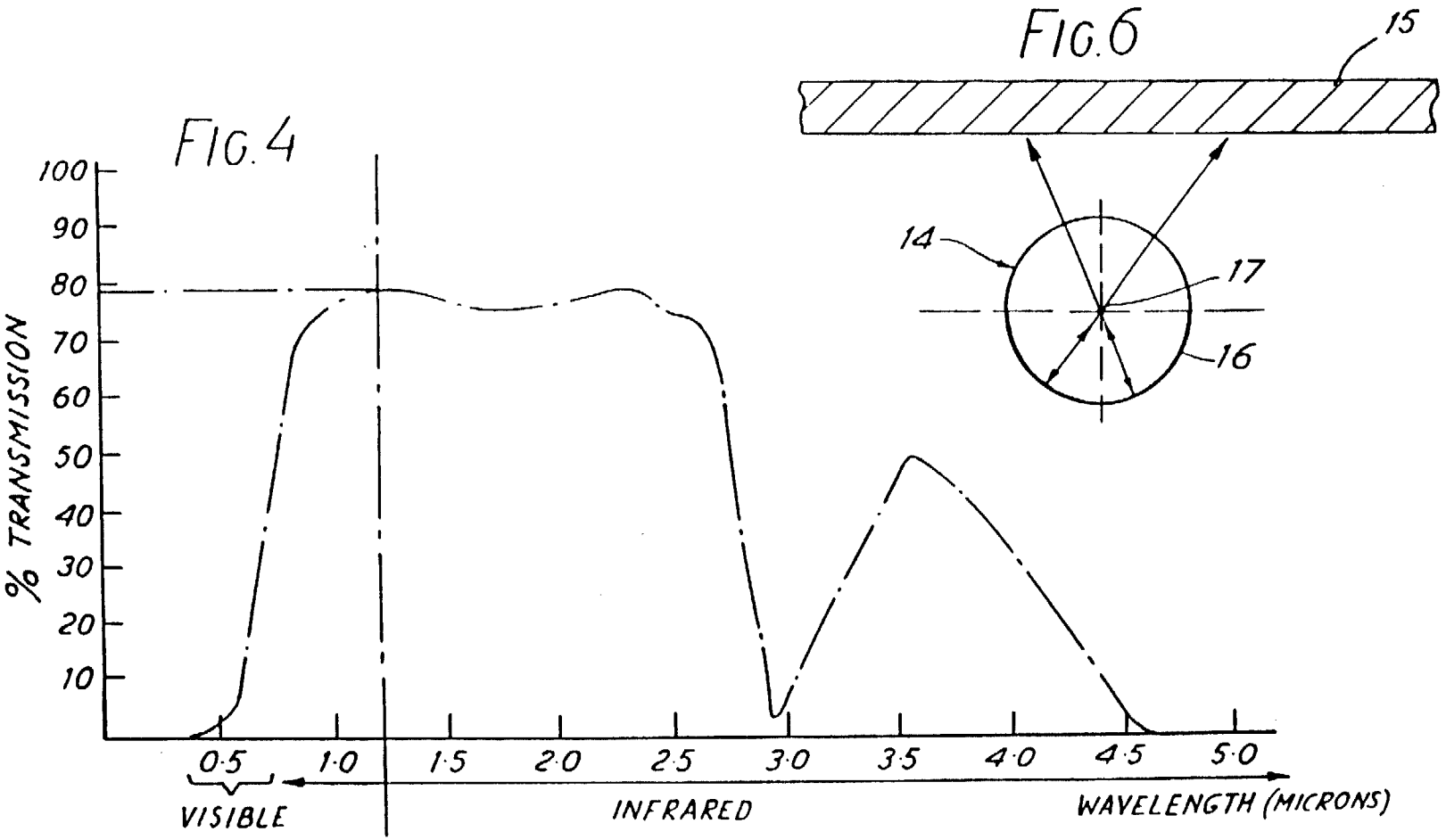
Figure 5:
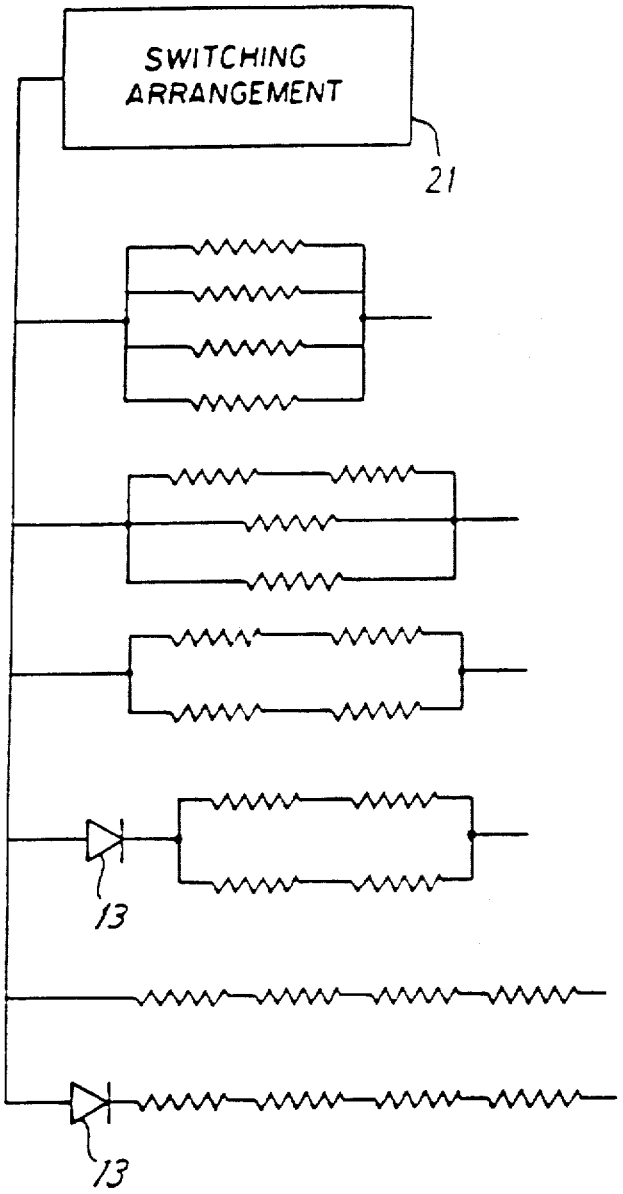

The invention will now be further described by way of example only with reference to the accompanying drawings, wherein:

FIG. 1 shows a plan view of an embodiment of the present invention,

FIG. 2 shows a sectional view on II—II in the direction indicated, of the embodiment shown in FIG. 1, FIG. 3 shows a sectional view on III—III, in the direction indicated, FIG. 4 shows a spectral transmission curve for a preferred type of glass ceramic utilised in the present invention, FIG. 5 shows various switching arrangements for power input control of the embodiment shown, and, FIG. 6 shows a schematic sectional view of part of the embodiment shown in FIG. 1.

Referring to FIG. 1, a generally circular shallow tray 1, preferably made of metal, has disposed therewithin, on the base thereof, a layer 2 of thermally insulative material, which may be fabricated from a microporous material, for example that known as Microtherm. The tray 1 has two extending flanges, 3 and 4, arranged on opposite sides of the rim of the tray 1, each flange having upturned end portions, 5 and 6, respectively.

A number of sources of infra-red radiation, preferably four, one being shown at 7, are disposed above the layer 2 of insulative material and are supported at each end by the flanges, 3 and 4.

A moulding 8 of ceramic fibre material is disposed above the tray 1 and press-fitted around the ends of each source 7 to provide a suitable packing therefor.

Each source 7 of infra-red radiation comprises a quartz, halogenated tubular lamp including a tungsten filament 17 (FIG. 2), one suitable example of which is described and claimed in copending British application No. 8308103, in the name of THORN EMI plc.

Each lamp has moulded ceramic end caps 9 (FIGS. 1 and 3), each enclosing a pinch-seal 9*p* (FIG. 3) located outside the cooking area, with an amp tag connector connected to an end of the filament 17 sealed therein, each end cap 9 is thermally shielded by the moulding 8 to prevent overheating of the associated pinch seal 9*p*, as discussed further hereinafter, and is provided with a location tab 10, so that the tubes can easily be inserted in gaps provided in the upturned portions 5 and 6, on the flanges 3 and 4.

The tray 1 and flanges 3 and 4 are preferably made of metallic material, and sufficient clearance is allowed in each gap provided for the end caps 9 to permit expansion of the tray and flanges without breaking the lamps, whilst providing sufficient support for the lamps during attachment of electrical wiring 19 to the amp tag connectors. It also permits conduction of heat away from the lamp pinch seals 9*p* via the flange to maintain satisfactory operating temperatures. Heat is also conducted away from the lamp ends by way of the electrical wiring attached thereto.

If further cooling of the pinch seals 9*p* is required, heat sinking and conventional cooling techniques disclosed in any of copending British application Nos. 8314451, 8316304, 8316306 and 8318457 may be employed, or any other suitable technique known to those skilled in the art.

The ceramic fibre moulding 8 is also sufficiently flexible to allow a certain amount of movement, caused by expansion and contraction of the tray and/or flanges whilst providing positive location for the lamps.

A number, preferably four, of the heating apparatuses shown in FIG. 1 are preferably disposed below a layer of glass ceramic, as shown at 15 in FIGS. 2, 3 and 6 which is in this example fabricated from Corning Black Cooktop 9632, to provide a slimline cooking hob, which may be of depth comparable with that of a standard worktop.

A thermal limiter 11, which is intended to limit the operating temperature of the glass ceramic layer, comprises a metallic rod arranged so as to operate a microswitch 12 and the limiter is provided between the lamps 7 and the layer 2 of insulative material and is adjusted so that expansion of the rod, due to heat emitted by the lamps, causes one end of the rod to operate the microswitch 12 when the temperature has reached a threshold value, thereby disconnecting the power to the lamps. During adjustment of the limiter, the effect of incident infra-red radiation thereon, which can cause variations in readings, should be taken into account.

FIGS. 2 and 3, in which like parts are labelled with like reference numerals with respect to FIG. 1, show sectional views of the apparatus shown in FIG. 1, indicating the shape of the features thereof, particularly of the tray 1 and the end caps 9, as well as showing the overall shallowness of the apparatus.

The properties of the glass ceramic material provide optimum transmission of infra-red radiation emitted from the infra-red lamps by matching the frequency of infra-red transmission through the glass ceramic with frequency of emission of the lamps.

The transmission characteristics of the glass ceramic material are such that wavelengths below 0.6 m are substantially absorbed. However, some visible radiation above this wavelength is transmitted, as red light, thus providing a visible indication of power level.

The heating arrangement, as described hereinbefore, is further advantageous, in that it provides an advantageously high nominal energy loading per surface area of the cooking hob. A typical nominal energy loading per surface area is approximately 6 W/cm$^2$, whereas in this embodiment, the matching between the energy emission characteristic of the lamps and the energy transmission characteristics of the cooktop is such that an increased energy loading of up to as much as 8 W/cm$^2$ may be achieved.

FIG. 4 shows a spectral transmission curve for the preferred ceramic, approximately 4 mm in thickness, and it can be seen at line A on the horizontal axis indicating wavelength that, at the peak value, ie. approximately 1.2 m, within the wavelength band of the infra-red radiation emitted from the sources utilised in the present invention, this material has a transmission factor of nearly 80%.

Operation of the apparatus is controlled by a multipole, preferably seven-pole, switching arrangement, 21 in FIG. 5, used in conjunction with the preferred configuration of four 500 W filament lamps, to provide a range of powers of approximately 2 KW to 147 W, by switching the filaments into various series and/or parallel combinations.

FIG. 5 shows six switching combinations of the foiur 500 W filament lamps, one shown at 7 in FIG. 1, thus providing six discrete control settings on a user-rotatable control knob (not shown) which correspond to six power outputs as shown to produce an optimised characteristic heat output curve. FIG. 5 also indicates the percentage of each power output relative to the total output i.e. 2000 W. It can be seen that a diode 13 is used in two of the six combinations to ensure that each control setting, especially the lower settings, provide an aesthetically-pleasing balanced effect of the visible radiation emitted from the filaments as seen through the layer of glass ceramic, as well as enabling lower powers, which are suitable for simmering purposes, to be provided by the combinations.

The diodes employed in each of the switching arrangements used respectively for the heating apparatuses incorporated within the cooking hob may be randomly poled to ensure that the loading on the mains is distributed evenly instead of being concentrated on one particular sequence of half-cycles of the mains waveform.

It has been found that, in some circumstances, harmonic disturbances may tend to be imposed on the mains supply in the switching combination, providing control setting No. 3. To mitigate this problem, it may be preferable to replace diode 13 with two oppositely-directed diodes, respectively, in the two parallel arrangements forming this combination, thereby suppressing the second and fourth mains harmonics.

Moreover, implementation of the switching arrangement ensures that any malfunction of one of the infra-red lamps still allows operation of the hob at reduced power levels.

A phase control device, incorporating diacs, triacs, etc, or any alternative conventional control, may be implemented at powers below approximately 200 W, so as to comply with international standards.

However, as an alternative to phase control, mark space control may be employed at higher power settings, in conjunction with one or more continuously energised lamps, so as to mask the disturbing flickering effect produced by the so controlled lamp or lamps. It may be further advantageous to employ, for example, two continuously-energised lamps, together with two burst-fire controlled lamps, as the two burst-fire controlled lamps may thus be operated at a considerably higher frequency than if four burst-fire controlled lamps were utilised.

The thermal limiter, shown at 11 on FIGS. 1 and 2, is used to ensure that the maximum operating temperature, ie. approximately 700° C., of the undersurface of the glass ceramic is not exceeded. The thermal limiter 11 needs to be adjusted to avoid nuisance tripping of the microswitch 12, thereby disconnecting the power supply to the lamps.

The incorporation of a thermal limiter into the apparatus is further advantageous, in that it allows the use of utensils of any material in conjunction therewith. However utensils having certain characteristics will perform differently with the present invention, than with other cooking hobs. As heating is substantially increased by infra red transmission to the utensil base, distorted infra-red absorbing utensils will operate more efficiently with the present invention, than with other electrical cooking hobs, where good contact is required between the utensil base and the heated area, to allow conduction of heat. Conversely utensils having highly reflective bases, which are not flat, will operate less efficiently with the present invention, as the infra red radiation will be reflected back to the hob surface. This will cause the operating temperature of the apparatus to increase and the thermal limiter to operate. In such circumstances the thermal limiter will switch the lamps on and off to maintain a satisfactory glass ceramic temperature, thereby providing a visual indication that the utensil being used is causing inefficient operation.

The insulative layer 2 is preferably approximately 12 mm thick, and it may have grooves provided in the surface thereof to accommodate a portion, preferably about one half, of the diameter of each of the lamps.

The use of quartz, halogenated lamps as the source of infra-red radiation is advantageous in that the lamp construction provides longevity of the filament, whilst providing high efficiency, the temperature of the filament reaching approximately 2400K, as well as providing a rapid response time for the cooking hob control.

As shown in FIG. 6, wherein a schematic view of a cross section of a lamp 14, in association with the glass ceramic layer 15 is illustrated, the lamp 14 has an integral oxide or other suitable reflector in the form of a coating 16 on the lower part thereof. A filament 17 of the lamp 14 is positioned at the focal point of the coating 16, so that downwardly-emitted radiation from the filament 17 is reflected either back towards the filament, or towards the glass ceramic layer 15.

As an alternative to, or in combination with, the reflective coating on each of the lamps, the surface of the insulative material may be provided with a reflective coating, such as a metallic oxide, or the surface layer of the insulative material may be enriched therewith, so that a reflective layer is disposed between the lamps and a major part of the body of the insulative material, thereby ensuring that the insulative material is substantially opaque to infra-red radiation.

The layer 2 of microporous insulative material, used in conjunction with the reflective coating of the lamps and/or the surface of the layer, is advantageous over conventional infra-red cooking hobs, as emission from the lamp matches transmission by the glass ceramic layer, consequently reflected radiation passes through the glass ceramic layer also. Furthermore, the insulative material or reflective coating thereon has better reflectivity at higher frequencies, minimising that portion of radiation which is absorbed by the layer and re-emitted at frequencies which do not pass through the glass ceramic layer.

The envelope of the lamp may have an alternatively shaped cross-section to the preferred circular cross-section, such as the coated half of the envelope being parabolic in cross-section, the filament 10 being positioned at the focal point of the parabola.

Alternative materials, such as glass ceramic, may be used instead of quartz for the envelope of the lamp, so that an optical filter may be incorporated within the tube.

The tube may also include a second quartz envelope having optical filter properties.

As well as, or instead of, incorporating an optical filter within the envelope, a separate optical filter may be used.

Alternatively a clear glass ceramic, such as Corning 9618, may be used in conjunction with a lamp envelope incorporating an optical filter to block out undesirable visible light. The filter may be provided in the form of a coating on the glass ceramic itself or alternatively, a wafer of filter material could be interposed between the lamp and the glass ceramic, or on the quartz envelope of the tube.

As an alternative, a conventional, mechanical cam-operated, bimetal switch may be used to set the amount of radiation required, thereby providing the advantages of low cost and reliability. Similarly, devices such diacs, triacs and phase controllers can be used.

A feed back temperature control device, such as that disclosed in British Pat. No. 2071969, may also be used, such as a device based on 'fibre optics'.

The apparatus may be used with or without the layer of glass ceramic, as any other supporting means may be utilised to provide support for a utensil and to protect the lamps.

Instead of placing utensils to be heated on the hob, the hob itself may be used as a cooking utensil.

To ensure that the infra-red radiation, or heat provided thereby, is transmitted to the food to be cooked, glass ceramic cooking utensils, which transmit infra-red radiation directly to the food, or utensils having an infra-red absorbent base, may be utilised.

The area of the hob surface illuminated by the lamp is not, of course, limited by the present invention to a substantially circular shape, but may be varied by using different shapes and/or sizes of the tray, such as a square or rectangular shape, as well as other suitable shapes and/or configurations of the lamps, such as circular, semi-circular, horse-shoe shape, concentric rings with aligned end portions, or lamps which can be tapped at various points along their lengths.

Flying leads may be used, as an alternative to amp tag connectors, at each end of the lamps.

The thermal limiter 11 may be disposed in any suitable position relative to the lamps, either above, below or at the same level as, and parallel to, the lamps. As a further alternative, it may be mounted in a vertical position relative to the lamps. The thermal limiter may be shielded from incident infra-red radiation so that it responds primarily to the temperature of the glass ceramic layer 2. The shield may take the form of a suitable infra-red reflective coating, such as a metallic oxide coating, or the limiter may be enclosed in a tube of ceramic fibre, as shown at 20 in FIGS. 1 to 3, or other suitable material. The limiter may, alternatively, be disposed within the insulative layer, in such a way as to provide shielding from incident infra-red radiation.

Alternative means for sensing and limiting the temperature of the glass ceramic layer, such as an electric control system, may be employed in the present invention, incorporating a temperature sensor which may be disposed in any suitable position within the heating apparatus. Such sensors may of course be shielded from incident infra-red radiation in a similar manner to the metallic thermal limiter.

As shown in FIGS. 1 to 3, the mounting 8 of ceramic fibre material provides a thermally-insulating wall, between the underside of the glass ceramic layer 15 and the upper surface of the thermally-insulative material 2, which confines the infra-red radiation from the lamps 7 to irradiate only a predetermined portion of the glass ceramic layer, thus defining the cooking area of the glass ceramic layer. Additionally, the end caps 9 and lamp pinch seals **9*p* are located outside of the thus-defined cooking area and thermally isolated or shielded therefrom, as discussed previously, as a result of the end caps being disposed in openings 8*o* (best shown in FIG. 3) in the moulding 8, and thus essentially enclosed by the moulding. In this way, the pinch seals 9*p* are protected from incident infra-red radiation from the lamp filaments 17**, to aid in maintaining the pinch seals at a sufficiently low operating temperature.

It can also be seen from FIGS. 1 to 3 that the temperature-sensitive rod of the thermal limiter 11 extends across the cooking area defined by the moulding 8, so that the thermal limiter directly monitors the temperature of the area of the glass ceramic layer 15, which is irradiated by incident infra-red radiation. The thermal limiter 11 can, in this way, accurately monitor the hottest parts of the glass ceramic layer 15 to avoid overheating thereof, particularly if the temperature-responsive rod is shielded, for example, by the abovementioned infra-red-reflective coating, from incident infra-red radiation from the lamps 7.

Other embodiments than that shown in FIGS. 1 to 3, including a thermally-insulative wall confining the infra-red radiation emitted by the lamps 7 and a suitable temperature sensor in thermal communication with the area of the glass ceramic layer 15 irradiated by the radiation, may also be used.

Alternatively, a thermostat, disposed outside the tray, may be employed. The thermostat can be adjusted to sense a temperature equal to the required glass ceramic temperature, either directly from the tray or via a thermal window open to the temperature within the tray.

Furthermore, the infra-red lamps may be disposed in any vertical or horizontal position relative to each other below the glass ceramic layer, so as to obtain an even distribution of infra-red radiation over the cooking area of the layer, whilst still maintaining a relatively high level of infra-red transmission therethrough.

Instead of utilising the material, Microtherm, any other suitable thermally insulative material may be used, for example microporous materials manufactured by Ego-Fischer, Wacker or Johns-Mansville, or mineral wool, glass fibre, calcium silicate, ceramic fibre, or alumina fibre, although in some cases a substantial thickness of the insulative material may be required to ensure efficient operation. A suitably strong material may also be fabricated so as to be self-supporting, thereby eliminating the need for a tray to support the material and lamps.

Alternatively, if a tray is utilised, it may be formed from a plastics material instead of a metal.

The preferred embodiment of the present invention operates at a colour temperature of approximately 2400 K, but, however, operation is possible at other colour temperatures within the range of approximately 1800 K–3000 K.

Heating apparatus in accordance with the present invention may be suitably orientated so that it may be employed in alternative applications, such as microwave ovens, grills, barbecues, toasters, electric fires and rotisseries.

In the preferred embodiment of the cooking hob, four heating apparatuses, in accordance with the present invention, are provided below the layer of glass ceramic. However, any number of such heating apparatuses may be employed and, in particular, a single heating apparatus may be used in a cooking hob of substantially smaller size than that of the preferred hob.

The present invention therefore provides a substantially improved heating apparatus, using infra-red radiation, of relatively slim construction, having a surprisingly rapid thermal response time and low boiling time due to high efficiency and power density, comparing favourably with that of conventional gas-fuelled cooking apparatus, as well as providing a smooth hob surface, which can easily be cleaned and which can be used in conjunction with a cooking utensil made of any material.

We claim:

1. A heating assembly comprising:

at least one tungsten halogen lamp capable when energized of generating infra-red radiation having a predetermined wavelength spectrum, a cooktop of glass ceramic material usefully transparent to infra-red radiation in part at least of said spectrum, means supporting said at least one lamp beneath said cooktop, thermally insulative and infra-red reflective means disposed beneath said at least one lamp and said cooktop and capable of inhibiting transmission of heat away from said cooktop and also of reflecting towards said cooktop without significant spectral change infra-red radiation generated by said at least one lamp and initially directed away from said cooktop, said thermally insulative and infra-red reflective means consisting at least of a non-metallic material, the cooktop, said at least one lamp and said thermally insulative and infra-red reflective means being juxtaposed and in closely proximate relationship with one another, whereby said assembly is of shallow construction and exhibits relatively rapid thermal response to energization and deenergization of said at least one lamp, the assembly further including limiting means responsive to the temperature of said cooktop to de-energize said at least one lamp when said temperature reaches a predetermined maximum value.

2. An assembly according to claim 1, wherein said non-metallic material comprises a microporous material.

3. An assembly according to claim 2, wherein said non-metallic material supports metallic oxide material reflective of infra-red radiation generated by said at least one lamp.

4. An assembly according to claim 1, wherein said non-metallic material supports metallic oxide material reflective of infra-red radiation generated by said at least one lamp.

5. An assembly according to claim 1, including a tray member containing and supporting said non-metallic material.

6. An assembly according to claim 1, including an optical filter for obstructing undesirable visible light.

7. A cooking hob incorporating at least one heating assembly as claimed in claim 1.

* * * * *

US004864104B1

REEXAMINATION CERTIFICATE (1939th)

United States Patent [19]

Crossley et al.

[11] B1 4,864,104

[45] Certificate Issued Mar. 2, 1993

[54] HEATING ASSEMBLY USING TUNGSTEN-HALOGEN LAMPS

[75] Inventors: Peter W. Crossley, Hampshire; Bernard F. Fellerman, Hayling Island; Graham H. Goodchild, Hampshire, all of England

[73] Assignee: Thorn Emi Patents Limited, Hayes, England

Reexamination Request:
No. 90/002,742, Jun. 3, 1992

Reexamination Certificate for:

| | |
|---|---|
| Patent No.: | **4,864,104** |
| Issued: | **Sep. 5, 1989** |
| Appl. No.: | **143,063** |
| Filed: | **Jan. 12, 1988** |

Related U.S. Application Data

[63] Continuation of Ser. No. 49,049, May 11, 1987, Pat. No. 4,751,370, which is a continuation-in-part of Ser. No. 563,930, Dec. 21, 1983, abandoned.

[30] Foreign Application Priority Data

| | | | |
|---|---|---|---|
| Dec. 24, 1982 | [GB] | United Kingdom | 8236797 |
| Mar. 24, 1983 | [GB] | United Kingdom | 8308105 |
| Aug. 1, 1983 | [GB] | United Kingdom | 8320717 |

[51] Int. Cl.[5] ..... H05B 3/74

[52] U.S. Cl. ..... 219/464; 219/460; 219/461

[56] References Cited

U.S. PATENT DOCUMENTS

| | | | |
|---|---|---|---|
| 3,335,261 | 8/1967 | Siegla et al. | 219/468 |
| 3,355,574 | 11/1967 | Bassett, Jr. | 219/464 |
| 3,375,346 | 3/1968 | Gaugler et al. | 219/449 |
| 3,579,021 | 5/1971 | Kimball | 313/274 |
| 3,612,828 | 10/1971 | Siegla | 219/464 |
| 3,663,798 | 5/1972 | Speidel et al. | 219/464 |
| 3,710,076 | 1/1973 | Frazier | 219/449 |
| 3,833,793 | 9/1974 | McWilliam et al. | 219/464 |
| 3,836,751 | 9/1974 | Anderson | 219/411 |
| 4,267,815 | 5/1981 | Gossler | 126/39 G |
| 4,296,311 | 10/1981 | Hagglund et al. | 219/464 |
| 4,350,875 | 9/1982 | McWilliams | 219/449 |
| 4,357,523 | 11/1972 | Bleckmann | 219/464 |
| 4,388,520 | 6/1973 | McWilliams | 219/464 |
| 4,414,465 | 11/1983 | Newton et al. | 219/449 |

FOREIGN PATENT DOCUMENTS

| | | |
|---|---|---|
| 556177 | 7/1932 | Fed. Rep. of Germany . |
| 2029549 | 12/1970 | Fed. Rep. of Germany . |
| 7222255 | 1/1973 | Fed. Rep. of Germany . |
| 2339768 | 2/1974 | Fed. Rep. of Germany . |
| 2546106 | 4/1977 | Fed. Rep. of Germany . |
| 2729929 | 1/1979 | Fed. Rep. of Germany . |
| 2809131 | 9/1979 | Fed. Rep. of Germany . |
| 2818815 | 11/1979 | Fed. Rep. of Germany . |
| 3004187 | 8/1980 | Fed. Rep. of Germany . |
| 2923884 | 12/1980 | Fed. Rep. of Germany . |
| 2024852 | 9/1970 | France . |
| 2138464 | 1/1973 | France . |
| 1273023 | 5/1972 | United Kingdom . |
| 1406028 | 9/1975 | United Kingdom . |
| 1433478 | 4/1976 | United Kingdom . |
| 2044057 | 10/1980 | United Kingdom . |
| 1580909 | 12/1980 | United Kingdom . |

OTHER PUBLICATIONS

The Microporous Principle, "Performance of Microtherm in Various Atmospheres".

Infrared and Its Thermal Applications, M. La Toison, 1964.

Schott Information, Jan. 1980.

*Primary Examiner*—Teresa J. Walberg

[57] ABSTRACT

A heating assembly including at least one infra-red emissive tungsten halogen lamp supported beneath a glass ceramic cooktop which allows useful quantities of the infra-red radiation, as emitted by the lamp (or lamps) and directly incident on the undersurface of the cooktop, to emerge from the assembly and above non-metallic, thermally insulating material contained as a layer in the base of a shallow tray. The layer contains, or supports at its surface, material which efficiently reflects the infra-red radiation emitted from the lamp (or lamps) substantially unchanged in spectral content so that useful quantities of the radiation so reflected and then incident on the undersurface of the cooktop emerge from the assembly to supplement the directly incident radiation.

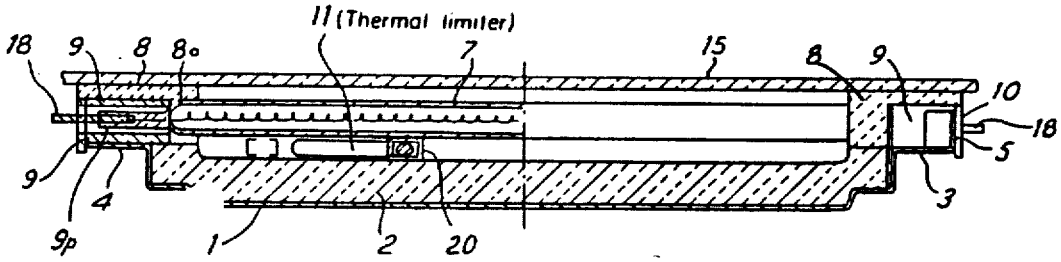

15
17
16
14

% TRANSMISSION
100
90
80
70
60
50
40
30
20
10
0.5
1.0
1.5
2.0
2.5
3.0
3.5
4.0
4.5
5.0
WAVELENGTH (MICRONS)
VISIBLE
INFRARED

| POWER OUTPUT | CONTROL SETTING | PERCENTAGE OF TOTAL POWER OUTPUT |
|---|---|---|
| 2000W | 6 | 100% |
| 1333W | 5 | 67% |
| 666W | 4 | 33% |
| 442W | 3 | 22% |
| 221W | 2 | 11% |
| 147W | 1 | 7% |
| 0W | 0 | 0% |

REEXAMINATION CERTIFICATE ISSUED UNDER 35 U.S.C. 307

THE PATENT IS HEREBY AMENDED AS INDICATED BELOW.

The drawing figures have been changed as follows: The informal drawings that were improperly printed in the patent have been replaced by the formal drawings that were of record in the application.

AS A RESULT OF REEXAMINATION, IT HAS BEEN DETERMINED THAT:

The patentability of claims 1-7 is confirmed.

* * * * *